United States Patent [19]

Tsuneta et al.

[11] 4,070,596

[45] Jan. 24, 1978

[54] IN-LINE PLURAL BEAMS CATHODE RAY TUBE HAVING COLOR PHOSPHOR ELEMENT STRIPS SPACED FROM EACH OTHER BY INTERVENING LIGHT ABSORBING AREAS AND SLIT-SHAPED APERTURE MASK

[75] Inventors: Asahide Tsuneta, Kawasaki; Takeshi Suzuki, Fukaya, both of Japan

[73] Assignee: Tokyo Shibaura Electric Co., Ltd., Kawasaki, Japan

[21] Appl. No.: 650,152

[22] Filed: Jan. 19, 1976

Related U.S. Application Data

[63] Continuation of Ser. No. 532,181, Dec. 12, 1974, abandoned, which is a continuation of Ser. No. 283,727, Aug. 25, 1972, abandoned.

[51] Int. Cl.[2] ..... H01J 29/30; H01J 31/20

[52] U.S. Cl. ..... 313/408; 313/470

[58] Field of Search ..... 313/403, 408; 96/36.1

[56] References Cited

U.S. PATENT DOCUMENTS

| | | | |
|---|---|---|---|
| 2,690,518 | 9/1954 | Fyler et al. | 313/408 X |
| 2,764,628 | 9/1956 | Bambara | 313/402 X |
| 2,842,697 | 7/1958 | Bingley | 313/471 |
| 2,973,454 | 2/1961 | Heil | 313/415 X |
| 3,146,368 | 8/1964 | Fiore et al. | 313/408 |
| 3,226,229 | 12/1965 | Kaplan | 313/408 X |
| 3,666,462 | 5/1972 | Kaplan | 96/36.1 |
| 3,731,129 | 5/1973 | Tsuneta et al. | 313/408 |
| 3,800,176 | 3/1974 | Gross et al. | 313/403 |
| 3,889,145 | 6/1975 | Suzuki et al. | 313/408 |

FOREIGN PATENT DOCUMENTS

| | | | |
|---|---|---|---|
| 1,203,791 | 1/1960 | France | 96/36.1 |
| 2,223,015 | 7/1973 | Germany | 96/36.1 |
| 1,372,805 | 11/1974 | United Kingdom | 96/36.1 |

*Primary Examiner*—Robert Segal

*Attorney, Agent, or Firm*—Schuyler, Birch, Swindler, McKie & Beckett

[57] ABSTRACT

A color cathode ray tube having color phosphor element strips spaced from each other by intervening light absorbing areas (black strips) which comprises an envelope; a faceplate; a phosphor screen formed on the inner wall of the faceplate; an electron gun unit so arranged in the neck portion of said cathode ray tube envelope as to emit in-line plural electron beams; and a slit-shaped aperture mask facing the faceplate, wherein the multicolor phosphor screen consists of a plurality of groups each consisting of several color phosphor element strips spaced from each other by a plurality of intervening light absorbing strips; and there is disposed adjacent to said color phosphor element strips a slit-shaped aperture mask perforated with a plurality of beam passing holes.

2 Claims, 5 Drawing Figures

IN-LINE PLURAL BEAMS CATHODE RAY TUBE HAVING COLOR PHOSPHOR ELEMENT STRIPS SPACED FROM EACH OTHER BY INTERVENING LIGHT ABSORBING AREAS AND SLIT-SHAPED APERTURE MASK

This is a continuation of application Ser. No. 532,181, filed Dec. 12, 1974, now abandoned which was a continuation of application Ser. No. 283,727, filed Aug. 25, 1972 now abandoned.

This invention relates to a color cathode ray tube, and more particularly to a cathode ray tube provided with a screen in which color phosphor element strips are spaced from each other by intervening light absorbing strips.

With the prior art black matrix type color cathode ray tube, the inner wall of the faceplate is provided with a phosphor screen in which there are scattered a large number of groups of three triangularly arranged phosphor dots producing red, blue and green lights, and the other portions of the screen than those where said phosphor dots are formed are coated with a black light absorbing layer. A shadow mask disposed adjacent to the phosphor screen is perforated with a plurality of holes shaped like the dots of the phosphor screen with one hole so positioned as to face one group of said three triangularly arranged phosphor dots. In the neck portion of the cathode ray tube envelope is received an electron gun unit consisting of three triangularly arranged electron guns for emitting three electron beams through said mask holes. According to the prior art cathode ray tube, the mask holes are enlarged by reetching so as to cause electron beams having a larger diameter than the phosphor dots to impinge thereon. Namely, an electron beam passing through one mask hole has a larger area of incidence than the surface area of each of the three phosphor dots.

With the conventional color cathode ray tube, the light absorbing area occupies as much as about 50 percent of the entire screen area, offering the advantage of reducing the reflection of external light, reproducing an image bearing distinct color contrast and permitting the application of a faceplate consisting of higher light permeability material than possible before due to said decreased reflection of external light. With such prior art color cathode ray tube, however, the phosphor dots are surrounded by a light absorbing layer, so that electron beam dots deflected perchance to said light absorbing layer can not be converted to visible light. Accordingly, proper adjustment of color purity is extremely difficult, particularly where electron beams passing through the mask holes do not fall exactly on the phosphor dots, failing to meet the demand for reproduction of a brighter, more distinct image. To obtain a brighter image, it may be contemplated to form phosphor elements in the shape of a strip in order to provide a larger illuminated area and to use an aperture grill as a color distinguishing mask. However, a mask made of such aperture grill can not be formed into a spherical shape because of its small mechanical strength. Further, mere change of the phosphor dots of the conventional delta gun color cathode ray tube to phosphor strips leads to the appreciable distortion of the triple arrangement of electron beams on the peripheral edges of an image. Accordingly, a light absorbing layer concurrently used as a guard band which is disposed on the peripheral edges of the image can not admit of a broader limit to the displacement of electron beam landing on the phosphor elements, resulting in the failure to adjust the color purity and whiteness of an image.

It is accordingly the object of this invention to provide a novel type of color cathode ray tube, which retains the advantages of a prior art black matrix type color cathode ray tube and is moreover capable of reproducing a much brighter image and easily adjusting its color purity.

A color cathode ray tube according to this invention comprises a faceplate disposed at the front part of the cathode ray tube envelope; a phosphor screen formed on the inner surface of the faceplate, said screen consisting of a plurality of groups of different color spaced vertically-extending phosphor strips arranged in a cycle repeating manner with an interspace between said strips coated with light absorbing material; a slit-shaped aperture mask positioned adjacent to said phosphor screen, said slit having a broader width in the horizontal direction than said phosphor strips; and an electron gun unit received in the neck portion of the cathode ray tube envelope and consisting of three electron linearly arranged electron guns for emitting three electron beams to the phosphor screen.

The present invention can be more fully understood from the following detailed description when taken in connection with reference to the accompanying drawings, in whcih:

Figure 4:
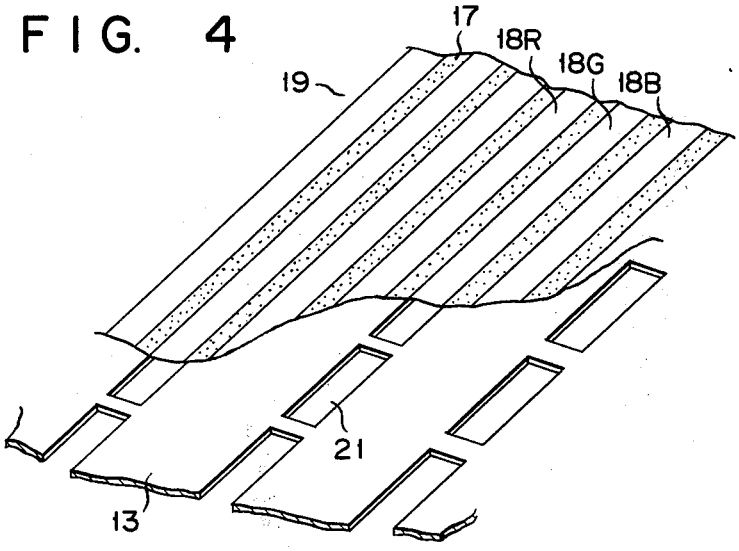
Figure 5:
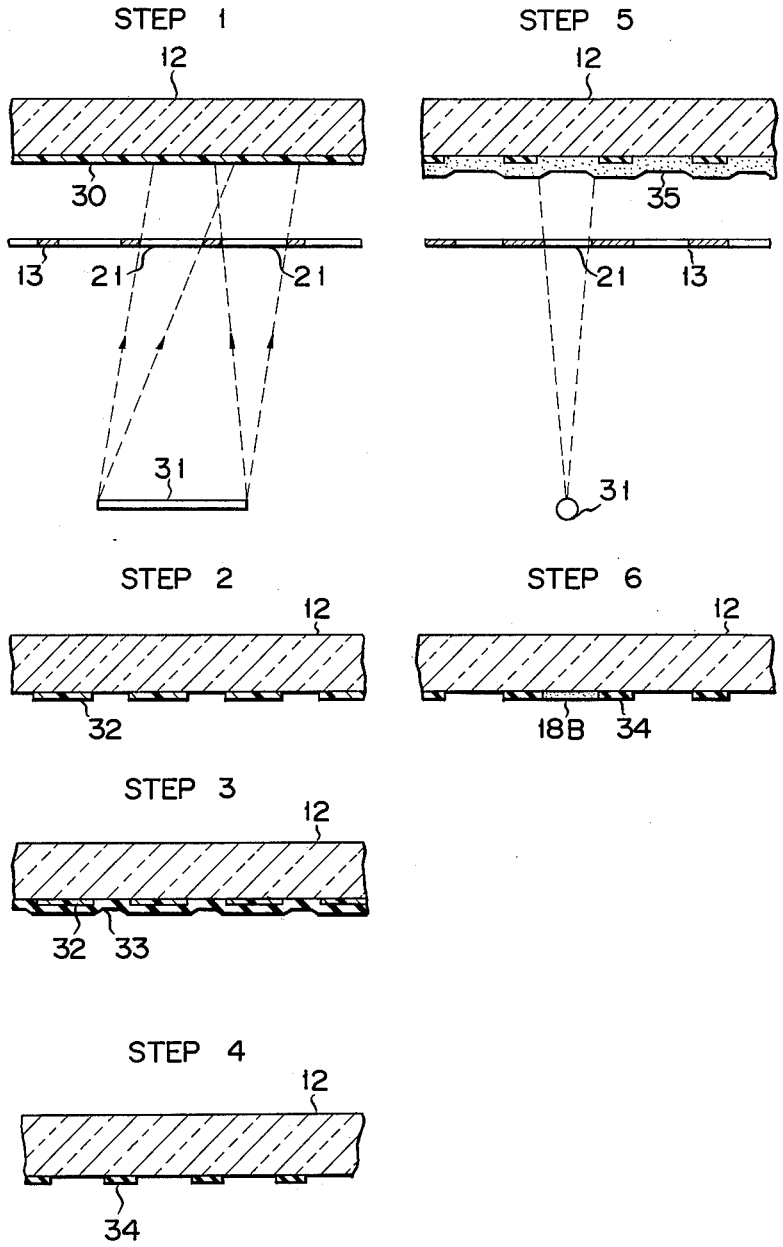

FIG. 4 indicates, partly in section, the relative positions of the phosphor strips of the screen and slit-shaped aperture mask; and FIG. 5 presents the sequential steps of preparing the phosphor screen of the cathode ray tube of the invention.

Figure 1:
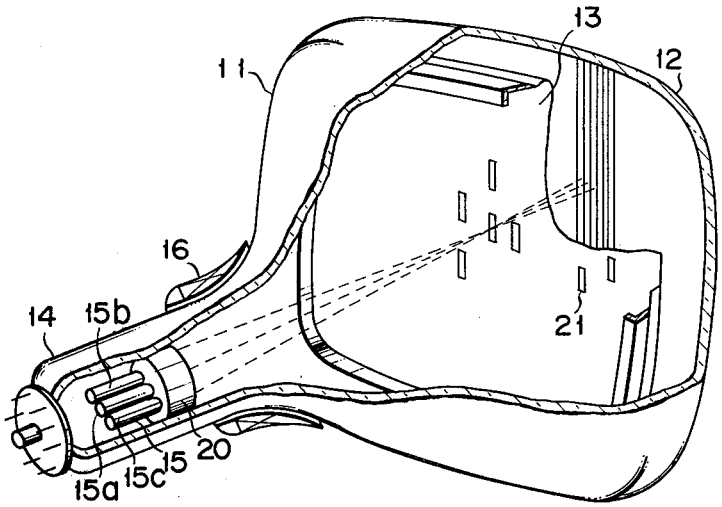
FIG. 1 is a perspective view of a cathode ray tube according to an embodiment of this invention.

As seen from FIG. 1, the cathode ray tube of this invention comprises a funnel portion 11; a face portion 12 formed on the front side of said funnel portion 11; an aperture mask 13 perforated with slits 21 and disposed inside of the face portion 12 so as to closely face a phosphor screen mounted on the inner wall of said face portion 12; and an in-line electron gun unit 15 received in the neck portion of the cathode ray tube envelope and consisting of three linearly arranged electron guns to emit three electron beams in the horizontal direction. The deflection section of the cathode ray tube enevelope has its periphery surrounded with a deflection coil 16 to deflect emitted election beams.

Figure 2:
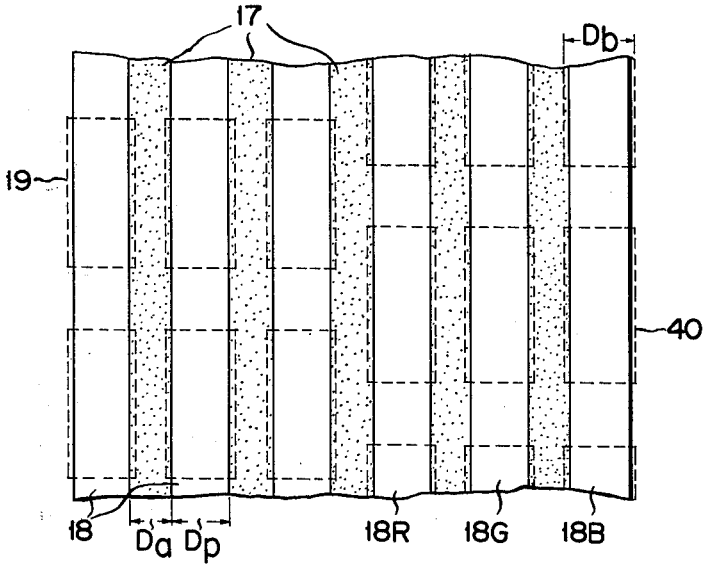
FIG. 2 illustrates, partly in enlargement, the phosphor screen of FIG. 1.
Figure 3:
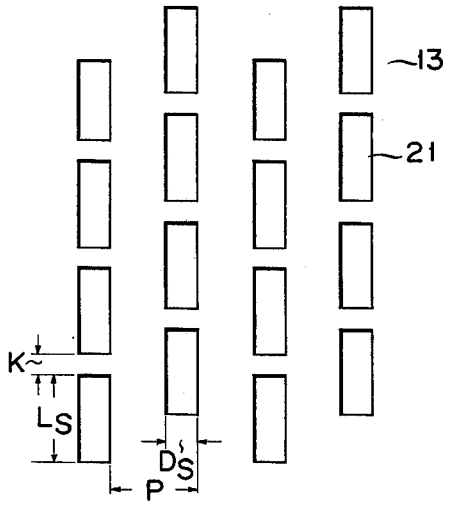
FIG. 3 shows the arrangement of shadow mask slits.

The inner wall of the face portion 12 is coated, as shown in FIG. 2, with a phosphor screen 19 which comprises a large number of parallel vertical light absorbing strips 17 made of black light absorbing material, for example, graphite and arranged at a prescribed space; and a plurality of parallel vertical phosphor element strips 18 spaced from each other by said light absorbing strips 17 which intervene between said phosphor element strips 18. These phosphor element strips 18 consist of a plurality of groups each consisting of three strips 18R, 18G and 18B producing red, green and blue lights respectively and arranged in a prescribed order. The aperture mask 13 is perforated with a plurality of rows of separate vertically elongate slits 21 arranged parallel with the phosphor element strips 18, said slits 21 being spaced from each other at a prescribed vertical interval K and a prescribed horizontal pitch P. Each row of said slits 21 corresponds to each phosphor element strip 18, the horizontal width $D_s$ of each slit 21 being made larger than the horizontal width Dp of each phosphor element strip 18. The electron gun unit 15 received in the neck portion 14 of the cathode ray tube envelope is of in-line type consisting of three electron guns 15*a*, 15*b* and 15*c* linearly arranged in the horizontal direction. The forward end of said electron gun unit 15 is fitted with a magnet 20 for converging electron beams emitted from the three elelctron guns 15*a*, 15*b* and 15*c* to a single point on the aperture mask 13.

There will now be described the method of preparing the phosphor screen 19 of a color cathode ray tube according to an embodiment of this invention. Referring to the first step of FIG. 5, the inner wall of the face plate 12 is coated with a film of polyvinyl alcohol (PVA) 30. Said PVA film 30 is exposed to a light supplied from a linear light source 31 through the slits 21 of the aperture mask 13. The reason why said linear light source 31 is used is that light beams brought to the PVA film 30 through the slits 21 overlap each other in the vertical direction, thereby substantially eliminating any nonilluminated portion on the surface of the PVA film 30 which might result from those sections of the mask 13 which intervene between the adjacent ones of the vertically arranged slits, with the result that the surface of the PVA film 30 is exposed to a vertically continuous beam of light. During said exposure step, the linear light source 31 has its position varied so as to form in a prescribed order strips of phosphor elements producing red, green and blue lights. In the second step, the nonexposed portions of the PVA film 30 are etched, while the exposed portions of said PVA film 30 are developed to form PVA strips 32. In the third step, the inner wall of the faceplate 12 on which there were previously formed said PVA strips 32 is coated all over with a layer 33 of light absorbing material, for example, graphite. In the fourth step, the coated inner wall of the face plate 12 is dipped in a solution of hydrogen peroxide to fall off those portions of the graphite layer 33 which are deposited thereon together with said PVA strips 32. The other portions of the graphite layer 33 remain intact to form graphite strips 34. The inner wall of the faceplate 12 thus treated is washed with sprayed warm water fully to eliminate any remnant of the dissolved PVA strips 32 and the unnecessary portions of the graphite layer 33. In the fifth step, the inner wall of the faceplate 12 now bearing said graphite strips 34 is coated all over with a phosphor slurry 35 prepared by mixing a green light-producing phosphor element with a solution of polyvinyl alcohol. Those portions of the coated layer of said phosphor slurry 35 which are to be positioned in the interspaces between the respective adjacent graphite strips 34 are exposed to a continuous strip form of light from the same linear light source 31 as used in step 1 through the aperture mask 13. In the sixth step, the non-exposed portions of the coated phosphor slurry layer 35 are etched, while the exposed portions thereof are developed to form a green light producing phosphor strip 18G. Later there are formed in succession the other phosphor element strips 18B and 18R producing blue and red lights respectively, thereby finishing the phosphor screen 19 illustrated in FIG. 2.

With the phosphor screen 19 prepared by the aforementioned process, the photosensitive PVA film 30 or phosphor slurry layer 35 is illuminated in a broader area than the area of each slit 21 of the aperture mask 13. Accordingly, the slits 21 of the aperture mask 13 are initially bored in a narrower size than the widths of the phosphor strips 18. After preparation of the phosphor screen 19, however, the mask 13 is etched again to enlarge the slits 21 so as to meet the object of practical application of a color cathode ray tube.

For reference, there are indicated below in concrete numerical values (in millimeters) the sizes of the phosphor screen 19 and aperture mask 13 of a 20 inch color cathode ray tube.

Width $D_2$ of graphite strips; 0.08
Width Dp of phosphor strips; 0.13
Width $D_s$ of shadow mask slits; 0.18
Length $L_s$ of shadow mask slits; 0.65
Bridge height K between shadow mask slits; 0.08
Horizontal pitch P between shadow mask slits; 0.60

The phosphor screen of the 20 inch cathode ray tube is prepared using an aperture mask of the following measurements:

Width of slits 0.10
Length of slits; 0.57
Bridge height between slits 0.16

After preparation of the phosphor screen, the aperture mask slits are enlarged by etching up to the abovementioned measurements.

When there is operated a cathode ray tube arranged as described above according to this invention, a central electron beam and side electron beams running alongside the central beam which are all emitted from an electron gun unit are converged to a single point on the aperture mask 13 by convergence means. The three electron beams thus converged impinge on the prescribed phosphor strips 18R, 18G and 18B respectively. Since, the phosphor elements take the form of equidistantly disposed strips, the arrangement of this invention is indispensable to enable the graphite strips concurrently acting as guard bands which are positioned on the peripheral edges of an image to allow for a broader limit to the displacement of electron beam landing on the phosphor elements, thereby permitting adjustment of the white color of the image over a fully broad range.

As shown in FIG. 2, the landing area 40 of each electron beam has the same shape as, but a larger size than the slit 21 of the aperture mask 13. Since, however, the slit 21 has a broader width $D_s$ than the width Dp of the phospher strip 18, the landing area of an electron beam has a broader width $D_b$ than the width Dp of the phosphor strip 18. To describe concretely, the landing area of an electron beam has a width $D_b$ of 0.19 mm and a length $L_b$ of 0.66 as against the width $D_s$ of 0.18 mm and length $L_s$ of 0.65 mm of the slit 21. A difference of 0.06 mm between the width $D_b$ of 0.19 mm of the beam landing area and the width Dp of 0.13 mm of the phosphor strip 18 constitutes a range of width over which horizontal adjustment of color purity is made possible.

An electron beam is made to land on the phosphor screen 19 at a space corresponding to the vertical interval K between the adjacent slits 21 of each row of the aperture mask 13. Since, however, each phosphor element 18 takes a continuous vertical strip form, an electron beam impinges thereon, attaining the later described effect.

The color cathode ray tube of this invention further has great advantages associated with an in-line type triple electron gun unit 15, for example, that it is prominently improved in convergence characteristics and facilitates manufacture of a broad deflection angle color cathode ray tube.

The aperture mask of a cathode ray tube according to this invention has a large number of separate short slits perforated at a prescribed vertical interval, with the resultant greater mechanical strength than an aperture grill having vertically elongate slits which has heretofore been devised as means for obtaining a bright image. The aperture mask of this invention can be handled with case and safety during the assembly of a color cathode ray tube and fully withstand any external shock after incorporated in the tube. Further in the present color cathode ray tube, the graphite strips 17 of the phosphor screen 12 (FIG. 1) collectively occupy 40 percent of the entire area of the screen 12, minimizing the reflection of external light and reproducing an image bearing good color contrast.

In addition to the above-mentioned advantages, the color cathode ray tube of this invention affords a fully broad range of effecting adjustment of chromaticity and is prominently improved in brightness and resolution.

There will now be described the above-mentioned broad range permitting adjustment of chromaticity. Said range is represented by a difference between the width $D_b$ of the electron beam landing area and the width Dp of the phosphor strip.

In the phosphor screen of the cathode ray tube of this invention, the phosphor element is formed in the shape of a continuous strip. If, therefore, the landing of an electron beam makes any vertical displacement due to errors of manufacture or the effect of terrestrial magnetism, the continuous strip formation of said phosphor element saves the chromaticity of the cathode ray tube from deterioration. In other words, adjustment of said chromaticity is very easy because it has only to be effected in one dimension, that is, in the horizontal direction. Further, electron beams pass through the mask slits in large amounts, that is, in high percentage and the phosphor strips have large light producing areas, enabling a bright distinct image to be reproduced.

There will now be described the resolution of an image by the cathode ray tube of this invention. The degree of said resolution is determined by the amount of information transmitted through the openings of the aperture mask. The interspaces between picture elements obtained through an aperture mask, that is, the width of scanning lines and the interval therebetween are so much larger than those required for the resolution of a picture by electron beams that the spatial interrelationship of the picture elements can be overlooked. Accordingly, the number E of levels obtained by quantizing the light and shade of picture elements, the number N of said picture elements and the amount I of transmitted information bear an interrelationship expressed by the following equation:

$$I = N \log E$$

As seen from this equation, the amount of information is determined by the number of picture elements. Comparison was made between the number of picture elements obtained by a color cathode ray tube provided with a round hole aperture mask and that obtained by a color cathode ray tube provided with a slit-shaped aperture mask of the kind described herein. With a color cathode ray tube having an aperture mask perforated with circular holes 0.24 mm in diameter spaced at a pitch of 0.56 mm, one hole allowed the passage of only one electron beam spot, resulting in the following equation:

$$N = 3.71S$$

where:

N = number of picture elements

S = the useful screen area of phosphor elements

In contrast, with a color cathode ray tube provided with an aperture mask perforated with a plurality of rows of vertically elongate slits each 0.18 mm in width $D_s$ and 0.65 mm in length $L_s$ which are arranged at a vertical interval K of 0.10 mm and a horizontal pitch P of 0.60 mm, each slit allowed the passage of 2.5 to 3 electron beam spots resulting in the following equation.

What we claim is:

1. A color cathode ray tube comprising an evacuated envelope; a multicolor image screen including a plurality of horizontally spaced groups of different color phosphor element strips each extending continuously throughout substantially the entire vertical extent of the screen, said strips being spaced from each other by intervening light absorbing strips, about 40 percent of the total area of said screen being covered by said light absorbing strips, each said light absorbing strip having a width less than the width of each of said phosphor strips, electron gun means for emitting in horizontally linear arrangement a central electron beam and a pair of side electron beams to the concave wall of said screen; converging means for converging said electron beams to pass simultaneously through a slit aperture of a mask; a mask perforated with a multiplicity of slit apertures, each of said apertures selectively directing said electron beams onto different ones of said phosphor strips of each group and located opposite to said electron gun means, said slit apertures being vertically elongated but vertically spaced apart by bridge elements which are much shorter vertically than the slit aperture length, the vertical height of each of said spaced bridge elements being less than the width of each of said slit apertures, the pattern for said strips being formed on an inner surface of said screen by a process including an exposing stage using a linear light source projecting light through the vertically spaced slit apertures of the maks, said light source having an effective length in a direction parallel to said strips greater than the length of one of the apertures in the shadow mask to extend the image of each aperture on said screen surface in the lengthwise direction to reduce the effects of the shadow cast by said bridge members on said screen surface and form said continuous vertical strips, said slit apertures of said mask being slightly wider than said phosphor strips but narrower than the combined width of a phosphor strip and an adjoining light absorbing strip and of length much shorter than the phosphor strips so as to have an area much smaller than the phosphor strips, whereby the landing areas of the electron beams on the phosphor strips have the same shape as said slit apertures and are wider but much shorter vertically than the strips, and not wider than the combined width of a phosphor strip and an adjoining light absorbing strip, and sensitivity to vertical landing errors is avoided so that only horizontal adjustment is necessary to achieve color purity.

2. A tube as claimed in claim 1 wherein the width of said beam landing area is less than said combined width of a phosphor strip and an adjoining light absorbing strip.

* * * * *

UNITED STATES PATENT OFFICE

CERTIFICATE OF CORRECTION

Patent No. 4,070,596 Dated January 24, 1978

Inventor(s) Asahide Tsuneta and Takeshi Suzuki

It is certified that error appears in the above-identified patent and that said Letters Patent are hereby corrected as shown below:

Column 2, line 68, change "at" to --by bridge elements defining--

Column 3, line 10, change "magnet" to --convergence cup--

Column 6, line 15, after "equation," insert the following:

-- $N = 5.40S$ to $6.59S$

Thus it was experimentally confirmed that the color cathode ray tube of this invention obtained an amount of information about 50 percent larger than was possible with the prior art color cathode ray tube, that is, displayed a much higher resolution.

As described above, this invention provides a new cathode ray tube presenting a very bright image and capable of facilitating various adjustments by a novel combination of a strip phosphor screen, slit-shaped aperture mask and in-line arranged electron guns. --

UNITED STATES PATENT OFFICE

CERTIFICATE OF CORRECTION

Patent No. 4,070,596 Dated January 24, 1978

Inventor(s) Asahide Tsuneta, Takeshi Suzuki

It is certified that error appears in the above-identified patent and that said Letters Patent are hereby corrected as shown below:

Page 1, after "[22] Filed: Jan. 19, 1976" the following should appear:

-- [30] Foreign Application Priority Data

Aug. 27, 1971 Japan . . . 651 63/71

Page 1, for the representative figure shown therein, substitute the attached Figure 1 of the drawings of the patent.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*

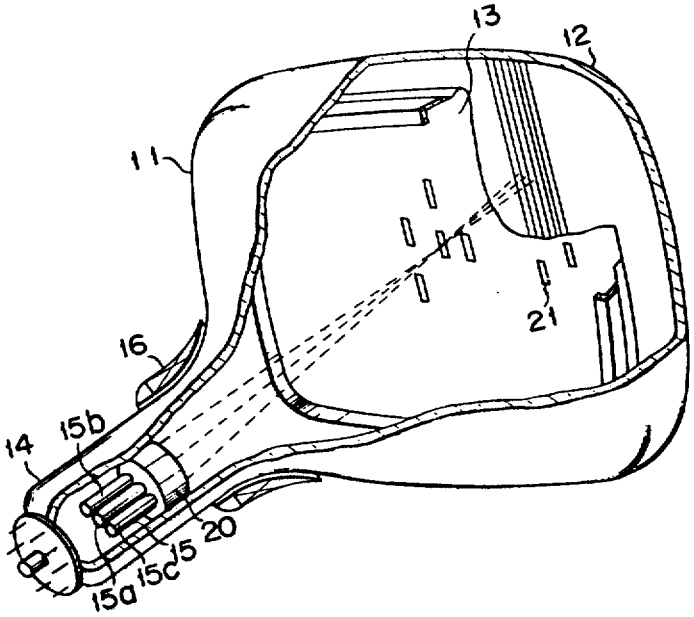
13
12
11
16
14
15b
20
15
15c
15a
21